US005599269A

United States Patent [19]

Oetlinger

[11] Patent Number: 5,599,269

[45] Date of Patent: Feb. 4, 1997

[54] PRESSER ASSEMBLY

[76] Inventor: Frank E. Oetlinger, 1433 Fox La., Grafton, Wis. 53024

[21] Appl. No.: 303,010

[22] Filed: Sep. 8, 1994

Related U.S. Application Data

[63] Continuation-in-part of Ser. No. 183,991, Jan. 18, 1994, Pat. No. 5,529,565.

[51] Int. Cl.[6] ..... B65H 35/10

[52] U.S. Cl. ..... 493/468; 225/96; 225/103; 493/373; 493/83; 493/342; 493/480; 493/82

[58] Field of Search ..... 493/82, 83, 342, 493/373, 468, 472, 480; 225/96, 105, 106, 104, 103; 83/175

[56] References Cited

U.S. PATENT DOCUMENTS

| | | | |
|---|---|---|---|
| 1,071,959 | 9/1913 | Schoenfeld | 83/175 |
| 1,404,239 | 1/1922 | Seybold . | |
| 1,911,742 | 5/1933 | Berry . | |
| 2,413,999 | 1/1947 | Shaner | 164/87 |
| 3,465,634 | 9/1969 | Blais | 225/96 |
| 3,794,228 | 2/1974 | Colwill | 225/105 |
| 3,964,655 | 6/1976 | Kotaro | 225/105 |
| 4,171,081 | 10/1979 | Vossen et al. | 225/97 |
| 4,243,166 | 1/1981 | Vossen et al. | 225/1 |
| 4,248,370 | 2/1981 | Schröter | 225/97 |
| 4,488,466 | 12/1984 | Jones | 225/105 |
| 4,493,234 | 1/1985 | Ziegler | 83/175 |
| 4,767,482 | 8/1988 | Diez | 83/175 |

FOREIGN PATENT DOCUMENTS

| | | | |
|---|---|---|---|
| 391299 | 10/1990 | European Pat. Off. . | |
| 2682633 | 4/1993 | France . | |
| 2022951 | 1/1971 | Germany . | |
| 2825631 | 1/1979 | Germany . | |
| 3033648 | 4/1982 | Germany . | |
| 593131 | 11/1977 | Switzerland . | |
| 286335 | 1/1971 | U.S.S.R. | 225/103 |

*Primary Examiner*—Jack W. Lavinder
*Attorney, Agent, or Firm*—Andrus, Sceales, Starke & Sawall

[57] ABSTRACT

A presser assembly is provided for supporting carton blanking scrap during a blanking operation. The presser assembly includes a presser rail having a first end mounted to a guide cylinder and a second end mounted to a second guide cylinder such that each end of the presser rail is vertically movable independent of the opposite end. This, in turn, prevents jamming of the presser assembly during the blanking operation.

9 Claims, 6 Drawing Sheets

PRESSER ASSEMBLY

CROSS REFERENCE TO RELATED APPLICATION

This application is a Continuation-in-Part of application Ser. No. 08/183,991 filed Jan. 18, 1994, now U.S. Pat. No. 5,529,565

BACKGROUND OF THE INVENTION

This invention relates to a blanking operation, and in particular, to a presser assembly for supporting carton blanking scrap during a blanking operation.

In the manufacture of cartons, small sheets of material are cut out of larger sheets. These smaller sheets are known as carton blanks which, in turn, are formed into boxes. The blanks are formed during a process known as a blanking operation.

In a blanking operation, the blanks are cut, but not removed, from the large sheet of material. After the blanks have been cut, the sheet is positioned over a frame for support. The frame includes large openings which correspond in size and in position to the carton blanks previously cut. Below the frame is a mechanism for stacking the blanks.

In order to knock the carton blanks from are sheet of material and hold the scrap material, a presser assembly is used. The presser assembly includes a support tool having a presser member and a presser rail depending therefrom. The presser rail is biased away from the support tool. As the support tool is lowered, the presser rail engages the sheet of material such that the large sheet of material is secured between the presser rail and the frame. The support tool continues to be lowered such that the presser member engages the carton blanks and knocks the blank out of the sheet of material. The carton blanks fall onto a stacking mechanism wherein the blanks are stacked.

If a carton blank is not completely knocked out from the sheet of material, it is possible that the carton blank scrap may be forced by the presser member onto the stacking mechanism. In addition, if the presser rail does not adequately hold the carton blanking scrap, the scrap may fall onto the stacking mechanism. A carton blanking scrap in the stacking mechanism may jam the mechanism thereby causing downtime, and hence, expense.

In order to securely hold the carton blank scrap, the present day presser rails are interconnected to the support tool by a plurality of guide cylinders. Each guide cylinder biases the presser rail away from the support tool. This gives the presser rail a certain mount of flexibility when engaging the carton blanking scrap. However, even with this limited flexibility, present day presser rails have been found to be inadequate.

Therefore, it is the primary object and feature of this invention to provide a presser assembly having a presser rail which securely holds carton blanking scrap during a blanking operation.

It is a further object and feature of the present invention to provide a presser assembly having a presser rail which is durable and maintains its shape over an extended period of time.

It is still a further object and feature of the present invention to provide a presser assembly which is easy to assemble and easy to mount to standard blanking operation machinery.

SUMMARY OF THE INVENTION

In accordance with the present invention, a presser assembly is provided for supporting carton blanking scrap during a blanking operation. The presser assembly includes a presser rail having a first end pivotably mounted to a first guide cylinder and a second end mounted to a second guide cylinder such that each end of the presser rail is independently, vertically movable during a blanking operation.

Each cylinder includes a housing which is mounted to a support. A guide member, telescoped within the housing, is interconnected to the housing by a stem mounted to a clevis. The clevis, in turn, is mounted to the presser rail. A spring is placed about the stem such that one end engages a bushing within the housing so as to bias the presser rail away from the support member.

Each clevis includes first and second side walls. Each side wall has an aperture which is in horizontal and vertical alignment with the other aperture. A pin extends through the vertically and horizontally aligned apertures in the clevis and a portion of the presser rail in order to interconnect the rail to each cylinder. The apertures in the clevis attached to one end of the presser rail are circular while the apertures in the other clevis are generally oblong in shape. The shape of the apertures allows each end of the presser rail to move vertically and move independently of the other end.

One feature of the presser assembly is that the stem is independent of the tubular guide member. In other words, the stem is not integral with or permanently connected to the guide member. This advantageously enables the stem and guide member to be more flexible with respect to one another thus preventing fractures which often occurred in prior art assemblies which welded these two components together. In the prior art, the weld caused the stem and guide member to be a rigid inflexible assembly which, in turn, resulted in the stem fracturing over time. Once the stem fractured the guide member, clevis and presser rail could drop into the blanking machine causing damage to the machine and consequent down time. Thus, the independence of the stem and guide member avoids fracturing of the stem and such consequent damages.

Another feature is the use of a vent hole in the housing which is located above the top dead center location of the reciprocating tubular guide member. This vent hole prevents paper dust from being sucked into the housing after a cutting operation. Without such a vent hole, a suction is formed within the housing as the housing returns upwardly after a cutting operation. This suction has a tendency to draw paper dust into the housing and in particular between the sliding surfaces of the housing and reciprocating tubular guide member. This paper dust acts as an abrasive which unless cleaned will damage the guide member causing costly repairs. Thus, the vent hole enables atmospheric air to enter into the housing to prevent a vacuum from forming therein.

Yet another feature of the invention is the provision of a crowned top surface for the housing. This crowned surface cushions the blow of the housing against the mounting for the upper end of the stem. This advantageously avoids fracturing or breaking of the stem over time.

In yet another aspect of the invention, there is provided a means for preventing the relative rotation of the housing with respect to the stem and presser rail. This rotation preventing means is employed when a single presser assembly is utilized with a presser rail. Under such circumstances, the presser rail must be prevented from rotating with respect to the housing so that it is always properly positioned in the blanking operation. A universal coupling is also employed to connect the presser rail to the clevis so that the presser rail is flexible and self aligning with respect to the sheet of material in the blanking operation.

Finally, although described and illustrated herein for use in a blanking operation, the presser assembly could just as readily be employed in a stripping operation where scrap is stripped away from the carton blanks after being die cut.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment. In the drawings.

DESCRIPTION OF THE ILLUSTRATED EMBODIMENTS

Figures 1, 3, 4, 5, 6, 7, 8:
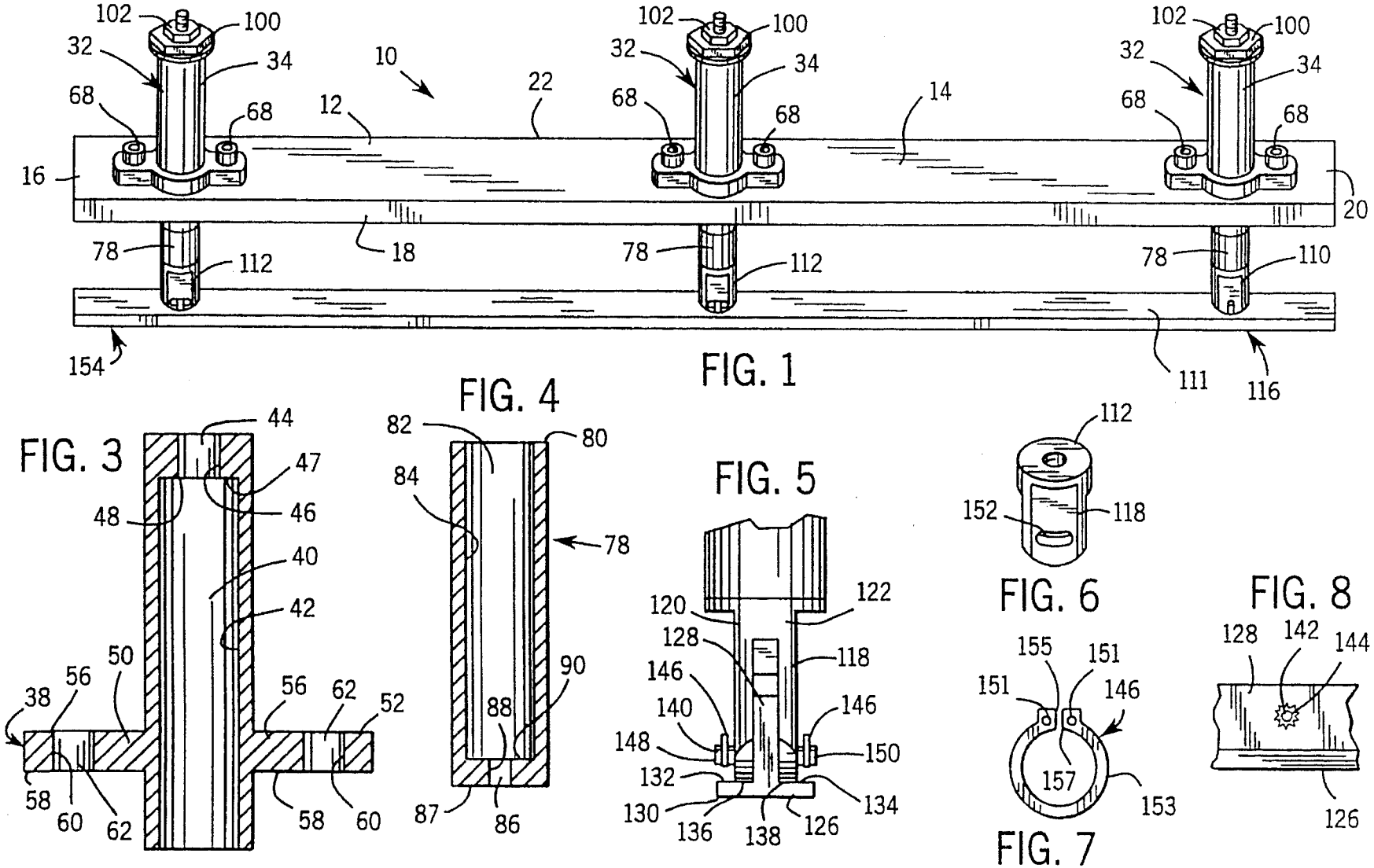
FIG. 1 is an isometric view of a presser assembly of the present invention.
FIG. 3 is a cross-sectional view of a housing of the guide cylinder shown in FIG. 2.
FIG. 4 is a cross-sectional view of a guide member of the guide cylinder shown in FIG. 2.
FIG. 5 is an end view of a portion of the presser assembly of FIG. 1.
FIG. 6 is an isometric view of a clevis having an oblong opening in each side wall of the presser assembly shown in FIG. 1.
FIG. 7 is an isometric view of a lock ring for mounting a guide cylinder to the presser rail as shown in FIG. 5.
FIG. 8 is a side elevation view of a portion of a presser rail of the presser assembly shown in FIG. 1.

Referring to FIG. 1, a presser assembly in accordance with the present invention is generally designated by the reference number 10. The presser assembly 10 includes a support 12 which is moved vertically during a blanking operation. As shown in FIG. 1, the support 12 is an elongated member having a first, upward face 14 and a second, downward face 15, FIG. 9. Each face is connected by four sides 16, 18, 20, and 22. In addition, each face is interconnected by an aperture 24 extending through support 12. The aperture is defined by a circular side wall 26 which engages face 14 at edge 28 and engages the downward face 15 at edge 30. Aperture 24 is provided in support 12 to facilitate the mounting of a cylindrical guide cylinder 32 to the support 12.

Referring to FIGS. 2, 3, 9 and 10, the cylindrical guide cylinder 32 includes a housing 34 for mounting to support 12. The housing 34 includes a tubular body portion 36 and shoulder portion 38 extending outwardly therefrom. Tubular portion 36 includes a cavity 40 defined by circular wall 42. A passage 44 defined by cylindrical wall 46 communicates with cavity 40. Walls 42 and 46 are joined by a fiat, circular shoulder 47.

Shoulder portion 38 of housing 34 includes a first arm 50 and second arm 52 interconnected by a neck portion 54 about the periphery of tubular portion 36. Each arm 50, 52 has an upper surface 56 and a lower surface 58. Each surface 56 and 58 is interconnected by a circular wall 60 which defines a bolt passage 62. In order to connect housing 34 to support 12, bolts 64 extend through bolt passage 62 in each arm 50, 52 of the housing 34. The bolts 64 are threaded into bolt receipt apertures 66 in the support 12. Each bolt 64 has a head 68 having a diameter greater than that of each bolt passage 62 in order to prevent housing 34 from sliding axially off bolts 64 when the bolts 64 are threaded into bolt receipt apertures 66.

Figure 9:
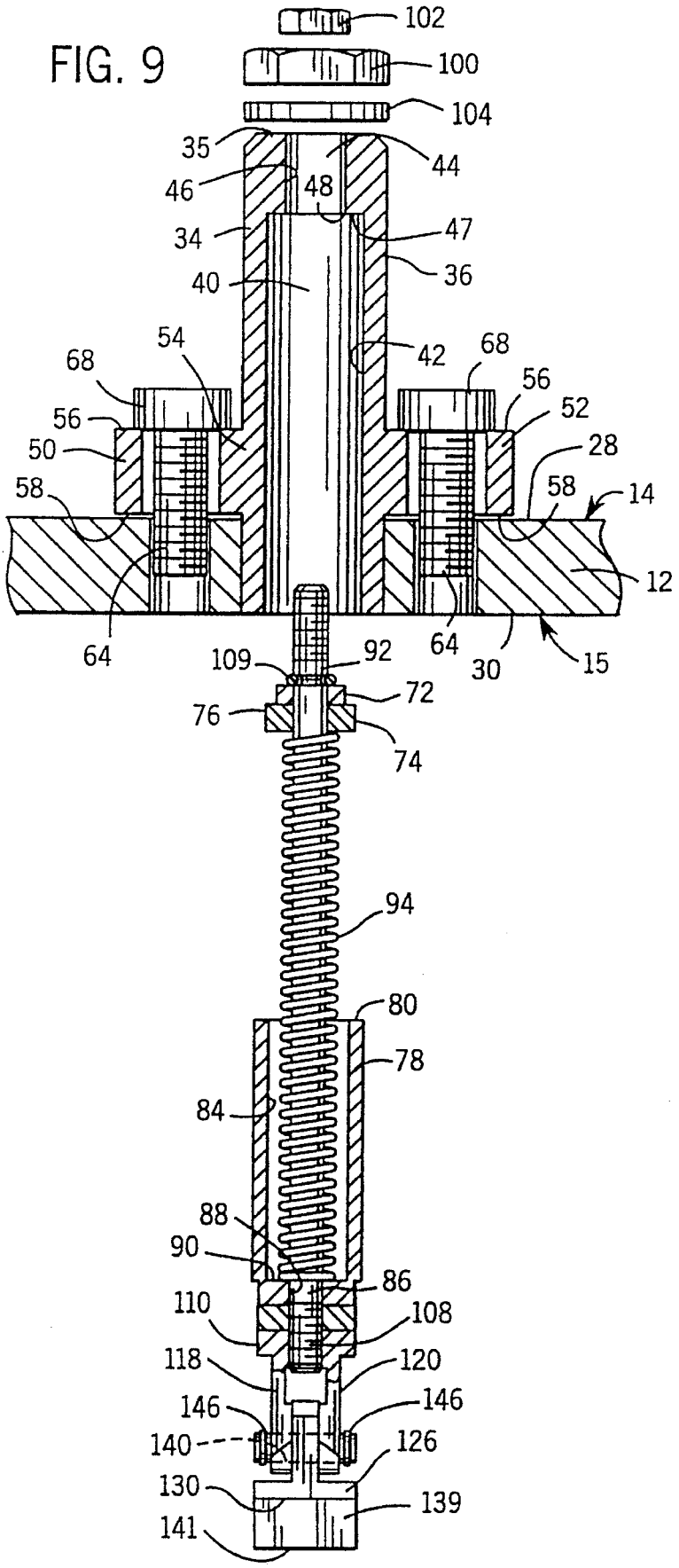
FIG. 9 is a partially exploded end view in cross section of a guide cylinder and a pressure rail of the present invention.
Figure 10:
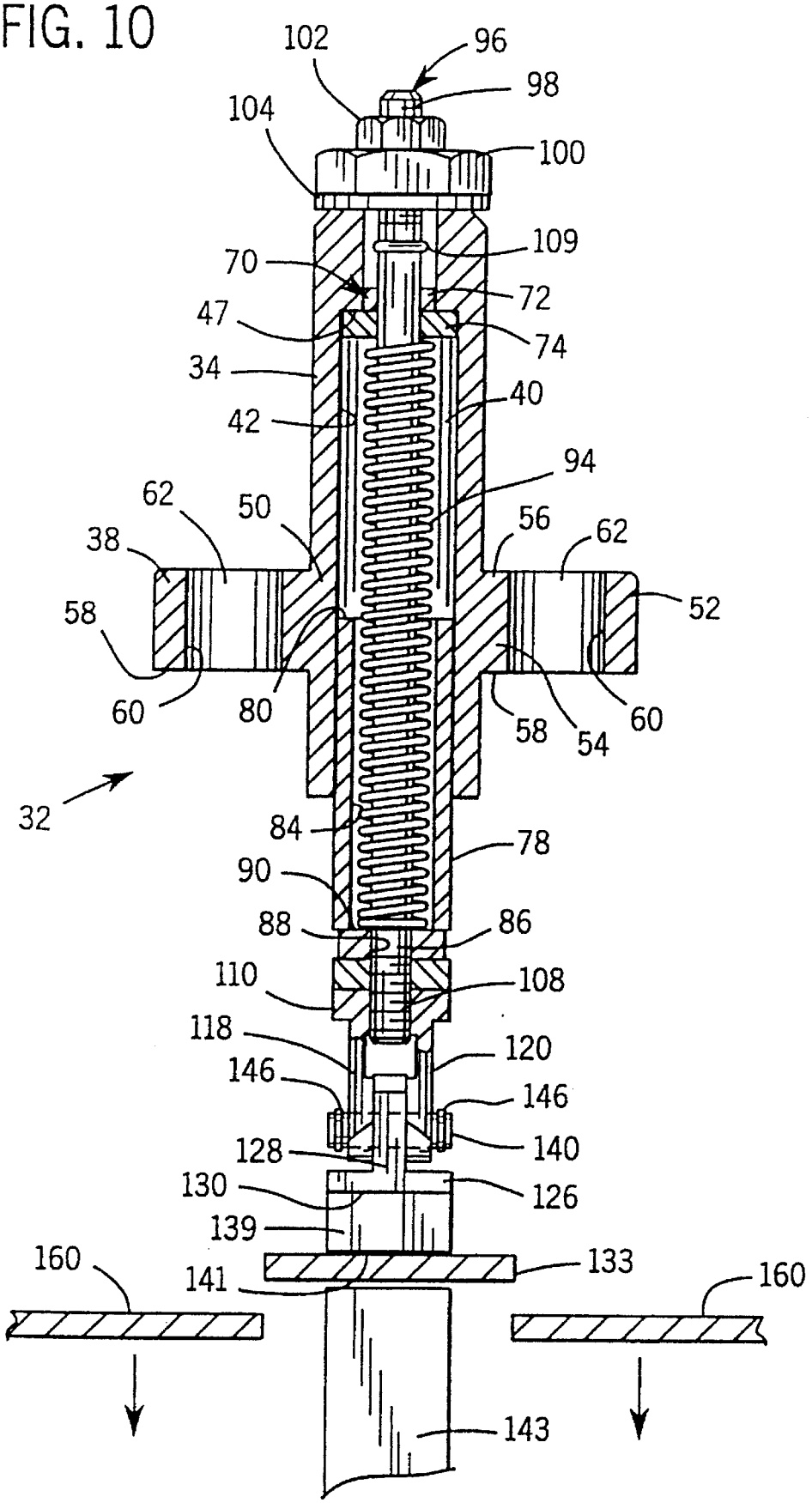
FIG. 10 is a cross-sectional end view of a guide cylinder and a presser rail of the present invention.

Referring to FIGS. 9 and 10, after mounting the housing 34 to support 12, a tubular guide member 78 is attached to housing 34. Cavity 40 in housing 34 is provided for axial receipt of tubular guide member 78. The tubular guide member 78 includes an upper end 80 orientated toward shoulder 47 of housing 34. Referring to FIG. 4, tubular guide member 78 also includes a cavity 82 defined by a cylindrical wall 84. Cavity 82 communicates with a passage 86 which is defined by cylindrical wall 88. Cylindrical walls 84 and 88 are joined by a fiat circular shoulder 90.

Figure 2:
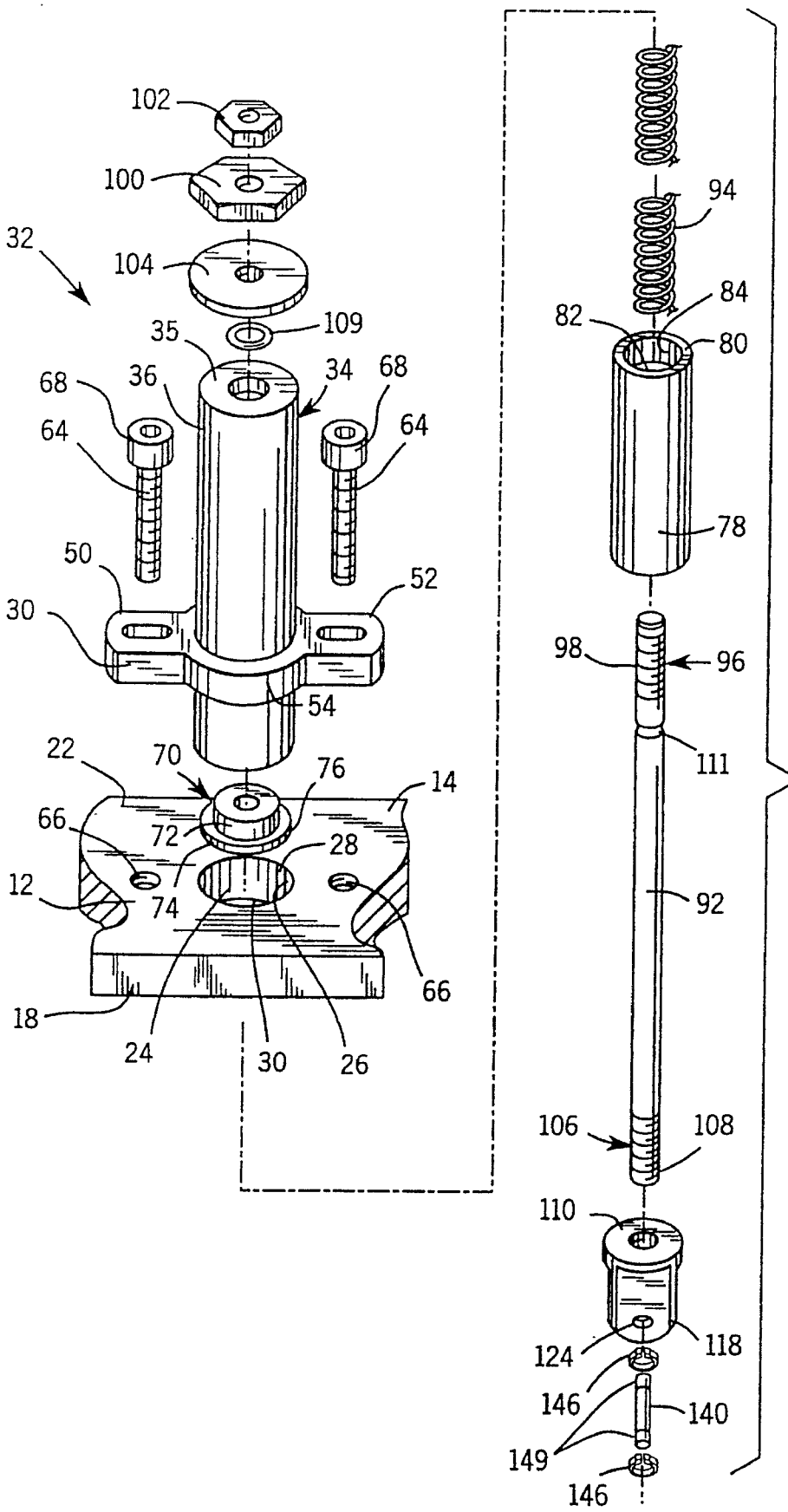
FIG. 2 is an exploded, isometric view of a guide cylinder of the presser assembly shown in FIG. 1.

As best seen in FIGS. 2, 9 and 10, in order to interconnect housing 34 to tubular guide member 78, stem 92 is provided. Stem 92 is inserted through passage 86 of tubular guide member 78, through a spring 94, and through a bushing 70. Bushing 70 includes a tubular body portion 72 and a head portion 74.

A snap ring 109, FIG. 9, may be placed in groove 111 about the circumference of stem 92 in order to limit the axial distance tubular guide member 78 may be biased away from bushing 70. This, in turn, facilitates the connecting of the tubular member to 78 to the housing 34. After connecting the tubular member 78 to presser rail 114, as hereafter described, snap ring 109 maintains spring 114 and bushing 70 on stem 92 when inserting stem 92 through passage 44 in housing 34. As stem 92 and bushing 70 are axially slid into cavity 40, the upper surface 76 of the head portion 74 of bushing 70 engages shoulder 47 of housing 34 and a first end 96 of stem 92 extends through passage 44 in housing 34. First end 96 of stem 92 includes threads 98 for receipt of nuts 100 and 102 to prevent stem 92 from sliding back through passage 44. A washer 104 may be placed between the upper portion 35 of housing 34 and nut 100.

A second end 106 of stem 92 also includes threads 108 to facilitate mounting the stem 92 to a clevis 110. When assembled, spring 94 axially bears against head 74 of bushing 70 and against shoulder 90 in tubular guide member 78 so as to bias tubular guide member 78 away from bushing 70. When interconnected to housing 34 and tubular guide member 78, stem 92 limits the axial distance tubular guide member 78 may be biased away from bushing 70.

There are two types of clevises for use with the presser assembly 10 of the present invention. Each clevis 110, 112 is used to interconnect the guide cylinder 32 to the presser rail 114. First clevis 110 is used to interconnect guide cylinder 32 to a first end 116, FIG. 1, of the presser rail 114. First clevis 110 includes first and second side walls 118, 120 which depend from a cylindrical body portion 122. Each side wall 118, 120 includes an aperture 124 which is horizontally and vertically aligned with the aperture on the opposing side wall. Aperture 124 in clevis 110 at the end 116 of presser rail 114 is generally circular in shape.

As best seen in FIG. 5, presser rail 114 is generally T-shaped. The presser rail 114 includes a pressing portion 126 and a connection portion 128. Pressing portion 126 has a lower surface 130 for engaging the scrap of material 133 and a pair of upper surfaces 132, 134 which engage lower surfaces 136 and 138, respectively, of clevis 110 when presser rail 114 is pivotally mounted to clevis 110. In the alternative, a rubber pad 139, FIGS. 9–10, may be affixed to lower surface 130 of presser rail 114. The rubber pad 139 includes a pressing surface 141 for engaging the scrap material and holding the scrap 133 between the pressing surface 141 and a frame 143.

In order to interconnect presser rail 114 to clevis 110, connection portion 128 is positioned between side walls 118 and 120. A pin 140 is slid through aperture 124 in each side wall 118, 120 of clevis 110 and through aperture 142 in connection portion 128 of presser rail 114. When first clevis 110 is interconnected to the connection portion 128 of presser rail 114, pin 140 in circular aperture 124 prevents horizontal movement of presser rail 114 with respect to guide cylinder 32. As best seen in FIG. 8, aperture 142 in connection portion 128 of presser rail 114 is circumferentially supported by insert 144 in order to reinforce aperture 142. In order to prevent pin 140 from sliding through one or both of the side walls 118, 120, a lock ring 146, FIGS. 5, 7 and 9, is placed in a groove 149, FIG. 2, on each end 148, 150 of pin 140. Lock ring 146 is generally circular in shape and has a small opening 151 at each end of a wire-like body portion 153. The tips of a needle nose pliers may be inserted into openings 151 in order to separate ends 155, 157 of body portion 153 so as to allow lock ring 146 to be placed over ends 148, 150 of pin 140 and into grooves 149.

In order to interconnect the remaining cylindrical guide members 32 to presser rail 114, second clevis 112, FIG. 6, is used. Like first clevis 110, second clevis 112 is threaded onto end 106 of stem 92. Clevis 112 is identical to clevis 110 except that aperture 124 is replaced with an oblong opening 152 in each side wall 118, 120. Identical parts of clevises 110 and 112 will be identified by the same reference characters. Each oblong opening 152 is horizontally and vertically aligned with the other oblong opening 152 in the opposing side wall. Second clevis 112 is connected by pin 140 and by lock ring 146 to presser rail 114 in the same manner as the first clevis 110 is connected to presser rail 114.

By placing an oblong opening 152 in the second clevis 112, pin 140 may slide horizontally in oblong opening 152 as each end 116, 154, of presser rail 114 moves vertically. As a result, ends 116, 154, of presser rail 114 may move vertically each in unison or independently of the opposite end of the presser rail 114. This, in turn, increases the flexibility of the presser rail 114 when engaging a non-planar sheet of web material. As a result, the carton blanking scrap is more adequately supported when the blanks 160, FIG. 10, are knocked out of the large sheet of material. This, in turn, prevents the scrap 133 from jamming the blanking operation machinery.

Figure 11:
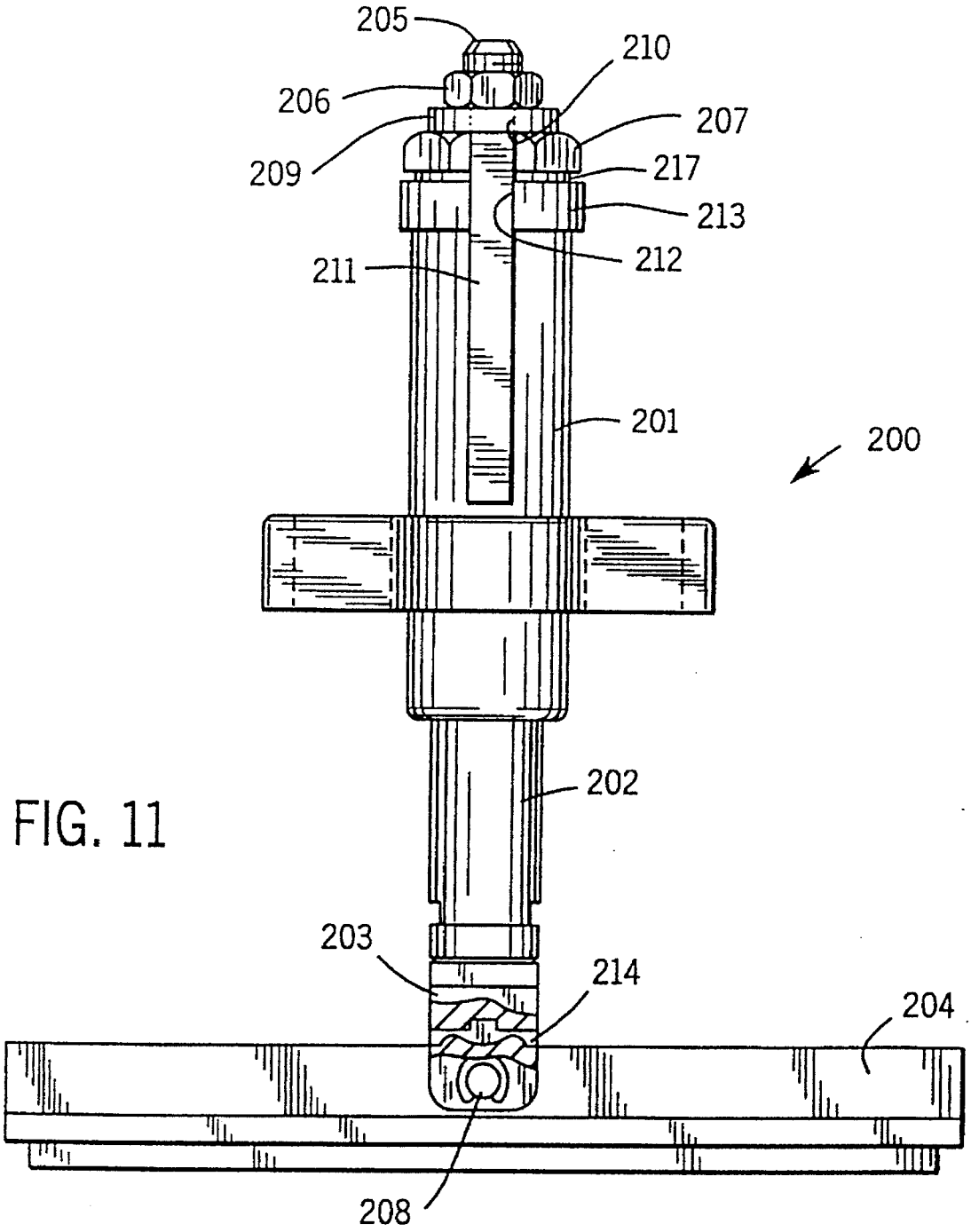
FIG. 11 is a side elevation view of a second embodiment of the presser assembly of the present invention illustrating the use of a single presser assembly with a short presser rail.
Figure 12:
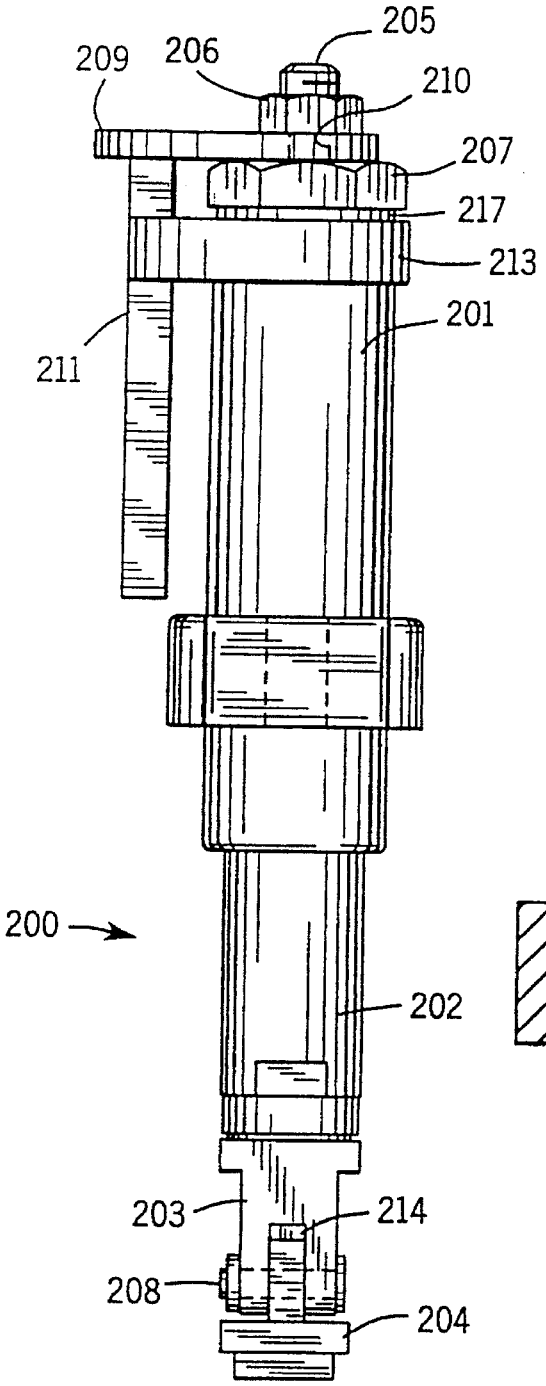
FIG. 12 is an end view of the presser assembly and rail of FIG. 11.
Figure 13:
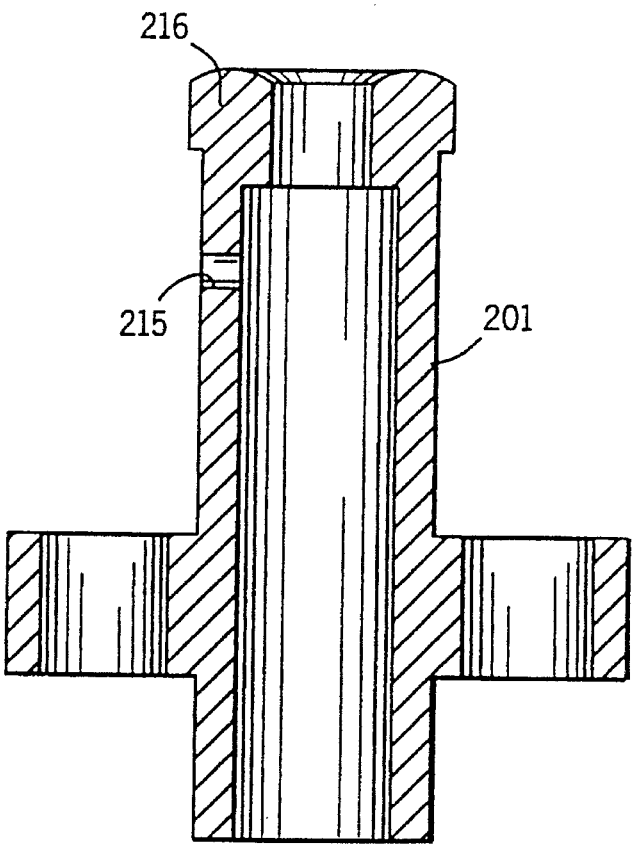
FIG. 13 is a cross-sectional view of a guide member for the presser assembly of FIG. 11.

Referring now to FIGS. 11–13, there is shown a second embodiment of a presser assembly 200 of the present invention. As illustrated, the presser assembly 200 includes a housing 201, a reciprocating guide member 202, clevis 203 and presser rail 204 substantially identical to those components as previously described therein. A stem 205 likewise extends through housing 201 and guide member 202 to be threadedly engaged at one end with clevis 203 and threadedly engaged at its other end with nuts 206 and 207 similarly as previously described herein with respect to the first embodiment. The operation of presser assembly 200 is substantially identical to the operation of presser assembly 10 as previously described herein, and therefore will not be repeated.

As shown in FIG. 11, rail 204 is relatively short with the connection of clevis 203 via pin 208 located centrally between opposite ends of rail 204. Since only a single assembly 200 is being employed with rail 204, there is a possibility that guide member 202, clevis 203 and rail 204 will rotate with respect to housing 201 as guide member 202 reciprocates within housing 201. In order to prevent the relative rotation of these components with respect to housing 201 there is incorporated an anti-rotation mechanism in presser assembly 200. As illustrated, this anti-rotation mechanism includes a plate 209 mounted to stem 205 by being sandwiched between nuts 206 and 207. The inner end of plate 209 includes an opening 210 through which stem 205 passes, and the outer projecting end of plate 209 includes a depending rod 211 extending downwardly therefrom. Rod 211 is positioned so that it is spaced slightly outwardly from the outer surface of housing 201 to provide clearance therebetween, and to avoid any interference with housing 201. Rod 211 extends between a slot 212 formed in a yolk member 213 which in turn is integrally connected to the top of housing 201. Yolk 213 thus captures rod 211, and prevents stem 205, guide member 202, clevis 203 and rail 204 from rotating with respect to housing 201.

The connection of rail 204 to clevis 203 includes a universal coupling connection having a compressible, resilient urethane connector 214 positioned between the top of rail 204 and clevis 203. Flexible connector 214 along with pin 208 provides a universal coupling which enables rail 204 to be flexible and self aligning with respect to the sheet material in the blanking operation. This prevents excessive wear and stress on components should the alignment of rail 204 upon engaging the sheet material be slightly off.

As shown best in FIG. 13, housing 201 also includes a vent hole 215 formed in its side wall. Vent hole 215 is located above the top dead center position of guide member 202 and functions to relieve the vacuum formed within housing 201 when guide member 202 moves from a position within housing 201 to an extending position as shown in FIG. 11, i.e. downwardly out of housing 201. During this movement a vacuum forms within housing 201 which results in paper dust being sucked into housing 201, as housing 201 returns upwardly and guide member 201 moves downwardly. Normally, without vent hole 215, paper dust would be drawn into housing 201 resulting in an abrasive action between the external surface of guide member 202 and the internal surface of housing 201. Vent hole 215 thus prevents damage between these two components.

As also best shown in FIG. 13, the top end of housing 201 includes a crowned surface 216. Crown surface 2 16 cushions the blow of housing 201 against rubber washer 217, as housing 201 reciprocates during the blanking operation. This prevents stem 205 from fracturing or breaking at its upper end.

Various modes of carrying out the invention are contemplated as being within the scope of the following claims particularly pointing out and distinctly claiming the subject matter regarded as the invention.

I claim:

1. A presser assembly for supporting carton blanking scrap, comprising:

a hollow housing defining an open top and an open bottom;

a longitudinally extending stem slidably received within said housing for reciprocal movement therein and having an upper end projecting from said open top and a lower end projecting from said open bottom;

a presser rail;

connector means for connecting the lower end of said stem to said presser rail;

bias means for biasing said presser rail away from said housing;

stop means at the upper end of said stem engagable with said housing for limiting the movement of said rail away from said housing;

a guide member surrounding said stem and received within the open bottom of said housing in telescoping relation with said housing for guiding said presser rail during its vertical reciprocating movement and an anti-rotation mechanism for preventing the relative rotation between said presser rail and said housing.

2. The presser assembly of claim 1 wherein said anti-rotation mechanism includes a yoke member on said housing and a rod connected to said stem, said yoke member including a slot for receiving and capturing said rod therein.

3. A presser assembly for supporting carton blanking scrap, comprising:

a hollow housing defining an open top and an open bottom;

a longitudinally extending stem slidably received within said housing for reciprocal movement therein and having an upper end projecting from said open top and a lower end projecting from said open bottom;

a presser rail;

connector means for connecting the lower end of said stem to said presser rail, said connector means includes a universal coupling to provide a flexible connection between said presser rail and stem;

bias means for biasing said presser rail away from said housing;

stop means at the upper end of said stem engagable with said housing for limiting the movement of said rail away from said housing; and a guide member surrounding said stem and received within the open bottom of said housing in telescoping relation with said housing for guiding said presser rail during its vertical reciprocating movement.

4. The presser assembly of claim 3 wherein said connector means includes a clevis, and said universal coupling includes a resilient pad disposed between said clevis and said presser rail.

5. A presser assembly for supporting carton blanking scrap, comprising:

a hollow housing defining an open top and an open bottom;

a longitudinally extending stem slidably received within said housing for reciprocal movement therein and having an upper end projecting from said open top and a lower end projecting from said open bottom;

a presser rail;

connector means for connecting the lower end of said stem to said presser rail;

bias means for biasing said presser rail away from said housing;

stop means at the upper end of said stem engagable with said housing for limiting the movement of said rail away from said housing;

a guide member surrounding said stem and received within the open bottom of said housing in telescoping relation with said housing for guiding said presser rail during its vertical reciprocating movement; and a vent hole in said housing communicating with atmosphere.

6. A presser assembly for supporting carton blanking scrap, comprising:

a hollow housing defining an open top and an open bottom;

a longitudinally extending stem slidably received within said housing for reciprocal movement therein and having an upper end projecting from said open top and a lower end projecting from said open bottom;

a presser rail;

connector means for connecting the lower end of said stem to said presser rail;

bias means for biasing said presser rail away from said housing;

stop means at the upper end of said stem engagable with said housing for limiting the movement of said rail away from said housing;

a guide member surrounding said stem and received within the open bottom of said housing in telescoping relation with said housing for guiding said presser rail during its vertical reciprocating movement;

wherein said stop means includes a rubber washer, and said housing includes a crowned surface surrounding said open top end engagable with said washer during reciprocal movement of said presser rail.

7. A presser assembly for supporting carton blanking scrap, comprising:

a hollow housing defining an open top and an open bottom;

a longitudinally extending stem slidably received within said housing for reciprocal movement therein and having an upper end projecting from said open top and a lower end projecting from said open bottom;

a presser rail;

connector means for connecting the lower end of said stem to said presser rail;

bias means for biasing said presser rail away from said housing;

stop means at the upper end of said stem engagable with said housing for limiting the movement of said rail away from said housing;

a guide member surrounding said stem and received within the open bottom of said housing in telescoping relation with said housing for guiding said presser rail during its vertical reciprocating movement; and a cushion disposed between said stop means and said housing for cushioning any engagement of said housing against said stop means during the vertical reciprocating movement of said stem.

8. The presser assembly of claim 7 wherein said cushion comprises a washer composed of a resilient material.

9. The presser assembly of claim 8 wherein said housing includes a crowned surface surrounding said open top end engagable with said washer during reciprocal movement of said presser rail.

* * * * *